US012421758B1

(12) United States Patent
Chesnut

(10) Patent No.: US 12,421,758 B1
(45) Date of Patent: Sep. 23, 2025

(54) WIRE STRETCHER INCLUDING DETACHABLE BLADE

(71) Applicant: James Chesnut, London, KY (US)

(72) Inventor: James Chesnut, London, KY (US)

( * ) Notice: Subject to any disclaimer, the term of this patent is extended or adjusted under 35 U.S.C. 154(b) by 814 days.

(21) Appl. No.: 17/735,176

(22) Filed: May 3, 2022

Related U.S. Application Data

(60) Provisional application No. 63/225,967, filed on Jul. 27, 2021.

(51) Int. Cl.
*E04H 17/26* (2006.01)

(52) U.S. Cl.
CPC ..... *E04H 17/266* (2013.01)

(58) Field of Classification Search
CPC ..... E04H 17/266
See application file for complete search history.

(56) References Cited

U.S. PATENT DOCUMENTS

| | | | | |
|---|---|---|---|---|
| 1,088,469 | A | 2/1914 | Smith | |
| 3,825,228 | A | 7/1974 | Greutman | |
| 7,891,640 | B2 | 2/2011 | Price | |
| 11,629,522 | B1 * | 4/2023 | Soto | E04H 17/266 256/37 |

* cited by examiner

*Primary Examiner* — Daniel Jeremy Leeds
(74) *Attorney, Agent, or Firm* — BUSINESS PATIENT LAW, PLLC

(57) ABSTRACT

A wire stretcher adapted to stretch wire. The current wire stretcher is particularly useful in building fences.

10 Claims, 3 Drawing Sheets

WIRE STRETCHER INCLUDING DETACHABLE BLADE

PRIORITY

Applicant claims the benefit of U.S. Provisional Application No. 63/225,967—Wire Stretcher—filed Jul. 27, 2021.

BACKGROUND OF THE INVENTION

A. Field of the Invention

Among other things, the present invention is a device for stretching and aligning wire utilized in the construction of fences. After stretching, the wire is secured to fence posts.

B. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

References that may indicate a state-of-the-art for the current invention include: 1) U.S. Pat. No. 1,088,469—Smith discloses a wire fence stretcher; 2) U.S. Pat. No. 3,825,228—Greutman disclose a wire stretcher; and 3) U.S. Pat. No. 7,891,640—Price discloses a fence stretcher system.

Among other things, none of the above listed references disclose a blade connectable to a blade holder of a wire stretcher: the connectable blade comprising: a) a first side; b) a second side opposed from the first side; c) a third side and a fourth side extending between the first side and the second side; and d) the second side comprising a plurality of notches; each notch comprising a channel extending inward from an orifice of the second side and a gripping end, wherein each notch is adapted to securely engage a corresponding strand of wire.

SUMMARY OF THE INVENTION

Prior to the current invention, it is believed there was no woven wire or wire stretcher that utilized a combination of a holder and attachable/detachable blades to stretch the wire. Meeting a long felt but unfilled need, among other things, the present invention also provides unique notches with gripping ends to securely engage the wire strands while stretching the wire strands and for easy disengagement of the strands of wire after the woven wire or wire is attached to one or more fence posts. Prior to the current invention, it is believed that there were no wire stretchers that utilized Applicant's simple structures of notches with gripping ends to hold and stretch the strands of wire.

An aspect of the present invention is to provide a wire stretcher with a holder for holding a blade adapted to engage one or more strands of the woven wire.

Still another aspect of the present invention is to provide a wire stretcher where a first blade can be easily detached from the holder and a second blade replacing the first blade can be easily attached to the holder.

It is still another aspect of the present invention to provide a wire stretcher with notches for holding strands of wire.

Yet another aspect of the present invention is to provide a notch with a gripping end for each strand of wire.

Still another aspect of the present invention is to provide a wire stretcher that is functional with a source of power distinct from the wire stretcher.

It is still another aspect of the present invention to provide a connectable blade for a wire stretcher that is also functional as a wire stretcher apart from the connectable blade holder.

A preferred embodiment of the current invention can be described as a wire stretcher comprising: a) a holder comprising a first side and a plurality of compatible first connectors and second connectors extending away from the first side; each connector comprising corresponding openings therethrough and perpendicular to the first side; b) a detachable blade comprising: i) a first side, a second side opposed from the first side, wherein the first side of the blade contacts the first side of the holder and the first side and the second side are connected to a third side and a fourth side of the blade; ii) a plurality of apertures, extending through the blade, proximate the first side of the blade, wherein each aperture is alignable with the corresponding openings of the plurality of corresponding first connectors and second connectors; and iii) a plurality of notches proximate the second side of the blade; the plurality of notches creating orifices in the second side, the third side and the fourth side of the blade, wherein each notch is adapted to securely engage a strand of woven wire; c) a plurality of fasteners engaging openings and the apertures such that the first side of the blade engages the first side of the holder; and d) a handle attached to the second side, opposite the first side, of the holder; the handle connectable to a source of power adapted to cause the wire stretcher to stretch the woven wire.

Another preferred embodiment of the current invention can be described as a wire stretcher comprising: a) a holder comprising a first side and a plurality of compatible first connectors and second connectors proximate the first side; each connector comprising an opening therethrough; b) a detachable blade comprising: i) a first side, a second side opposed from the first side, wherein the first side of the blade contacts the first side of the holder and the first side and the second side are connected to a third side and a fourth side of the blade; ii) a plurality of apertures, extending through the blade, wherein each aperture is alignable with the compatible openings of the plurality of corresponding first connectors and second connectors; and iii) a plurality of notches proximate the second side of the blade; each notch is adapted to securely engage a strand of a wire; c) a plurality of fasteners engaging openings and the apertures such that the first side of the blade engages the first side of the holder; and d) a handle attached to the second side, opposite the first side, of the holder; the handle connectable to a source of power adapted to cause the wire stretcher to stretch the wire.

Yet another preferred embodiment of the current invention can be described as a blade connectable to a blade holder of a wire stretcher: the connectable blade comprising: a) a first side; b) a second side opposed from the first side; c) a third side and a fourth side extending between the first side and the second side; and d) the second side comprising a plurality of notches; each notch comprising a channel extending inward from an orifice of the second side and a gripping end, wherein each notch is adapted to securely engage a corresponding strand of wire.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

Figure 1:
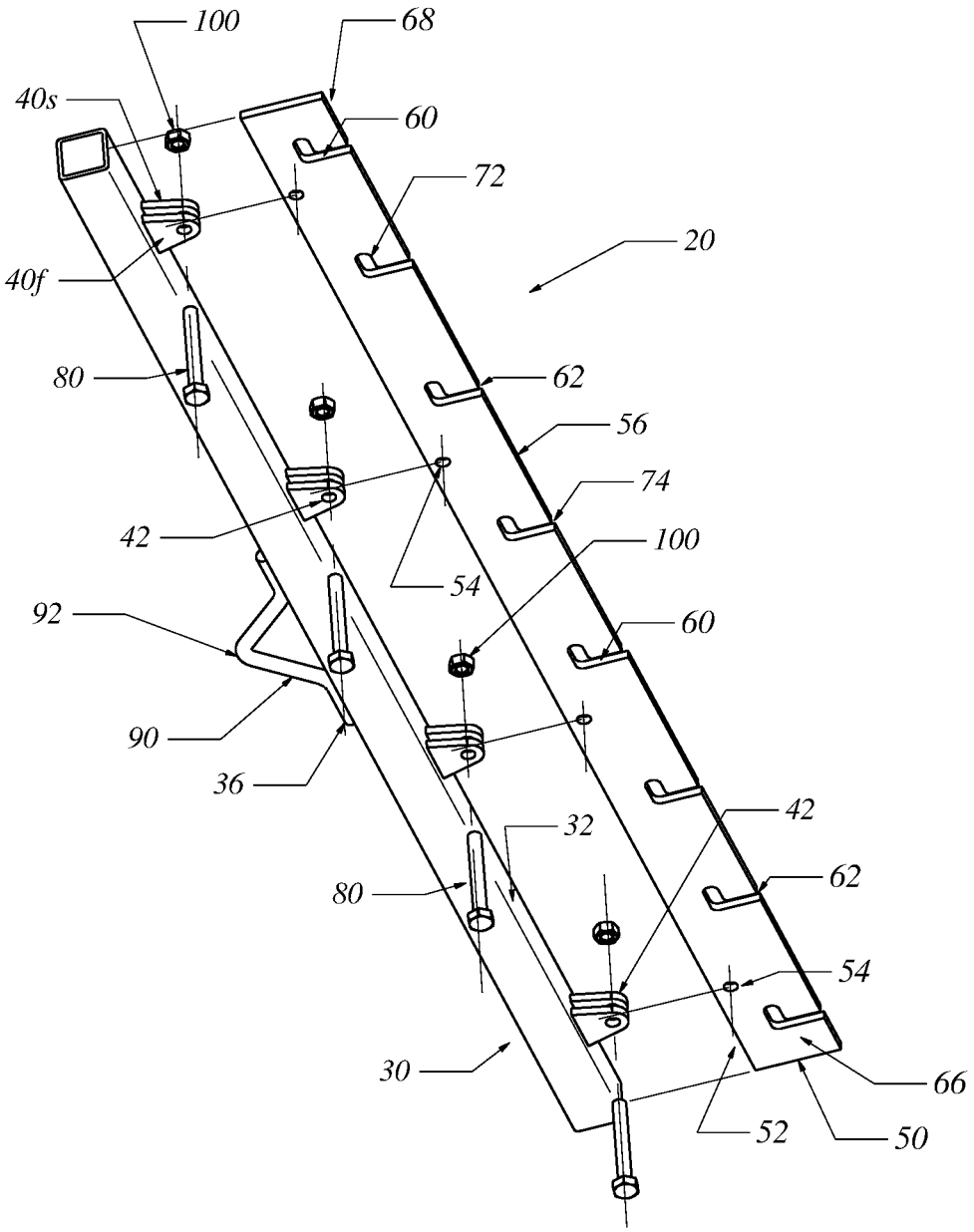
FIG. 1 is an exploded perspective view of an embodiment of the current wire stretcher.
Figure 2:
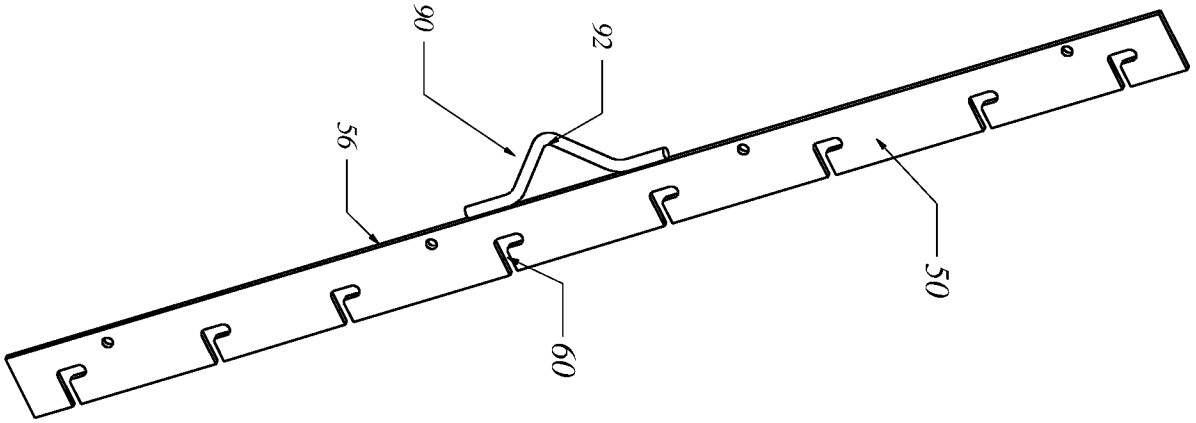
FIG. 2 is a perspective of a blade of the current wire stretcher.

With reference to FIGS. 1 and 2, embodiments of the wire stretcher are disclosed and enabled.

Within the scope current invention, a preferred embodiment of a wire stretcher (20) can include holder (30), detachable blade (50), a plurality of fasteners (80) and a handle (90) and a preferred embodiment of the connectable blade (50).

Holder (30) includes first side (32). Proximate first side (32) is a plurality of compatible first connectors (40*f*) and second connectors (40*s*). Connectors (40*f*, 40*s*) are provided with openings (42) that extend through connectors (40*f*, 40*s*).

Detachable or connectable blade (50) is provided with interconnected first side (52), second side (56) third side (66) and fourth side (68). Second side (56) is opposed from first side (52) of detachable or connectable blade (50). First side (52) and second side (56) of blade (50) are connected to third side (66) and a fourth side (68) of blade (50). In operation of a preferred embodiment, first side (52) of detachable blade (50) engages or contacts first side (32) of holder (30).

A plurality of apertures (54) can extend through blade (50). Apertures (54) are proximate first side (52) of blade (50). In operation, each aperture (54) is alignable with compatible openings (42) of the plurality of corresponding first connectors (40*f*) and second connectors (40*s*) of holder (30).

A plurality of notches (60) is positioned proximate second side (56) of blade (50). Notches (60) create orifices (62) that extend through portions of second side (56), third side (66) and fourth side (68) of blade (50). Each notch (60) is adapted to securely engage a strand of a woven or other wire. By way of illustration, notches (60) are provided with orifices (62), gripping ends (72) and channels (74) for securely engaging strands of wire. Gripping ends (72) of channels (74) can extend away from channels (74) at angles generally parallel first side (52) and second side (56) of detachable or connectable blade (50).

It has been discovered that wire stretcher (20) functions best when gripping ends (72) of notches (60) grip the strands of wire with sufficient force to stretch the strand while allowing the gripping ends (72) to be easily detached from the strand after one or more of the strands is connected to a fence post. Within the scope of the current invention, optimal widths of gripping ends (72) are from about $1/1000^{th}$ to about $5/1000^{th}$ of an inch wider than the strand. Depending on engineering parameters, notches (60) are equidistantly spaced apart from each other or one or more of the notches (60) can be spaced apart from another notch (60) at different distances.

A plurality of fasteners (80) such as bolts and nuts (100) and/or bolts can be utilized to secure first side (52) of blade (50) to first side (32) of holder (30). Fasteners (80) extend through openings (42) and apertures (54) causing first side (52) of the blade (50) to engage the first side (32) of the holder (30). When engineering parameters require, use of fasteners (80) allows quick and easy detachment of a first blade (50) and the subsequent attachment of a second blade (50) to holder (30). Blades (50) of wire stretcher (20) can be customized to accommodate wire strands of differing diameters.

In operation, handle (90) can be attached to a chain that is attached to a source of power distinct from handle (90). Select preferred embodiments of handle (90) are provided with angled catch (92) connectable to a device distinct from handle (90). Within the scope of the current invention, examples of sources of power utilizable with wire stretcher (20) include, but are not limited to, a manual ratchet or other apparatus acceptable in the art. When the source of power is activated, wire stretcher (20) or connectable blade (50) stretches strands of woven wire or other wire gripped by gripping ends (72) of blade (50).

Figure 3:
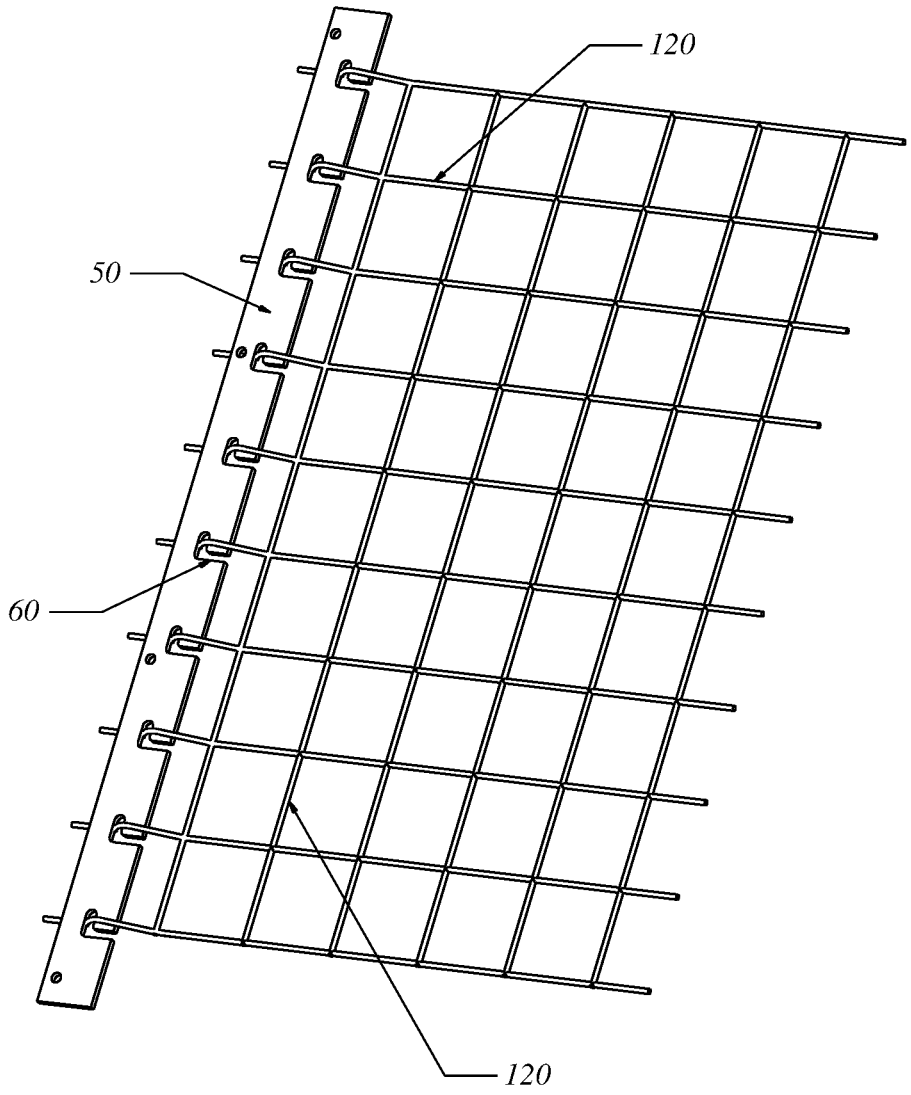
FIG. 3 of a portrayal of the blade of the wire stretcher connected to section of wire or woven wire.

FIG. 3 of a portrayal of blade (60) of connected to section (120) of wire or woven wire.

Applicant has enabled, described and disclosed the invention as required by Title of the United States Code and/or the Articles of the Patent Cooperation Treaty.

What is claimed is:

1. A wire stretcher comprising:

a) a holder comprising a first side and a plurality of compatible first connectors and second connectors extending away from the first side; each connector comprising corresponding openings therethrough and perpendicular to the first side;

b) a detachable blade comprising:

i) a first side, a second side opposed from the first side, wherein the first side of the blade contacts the first side of the holder and the first side and the second side are connected to a third side and a fourth side of the blade;

ii) a plurality of apertures, extending through the blade, proximate the first side of the blade, wherein each aperture is alignable with the corresponding openings of the plurality of corresponding first connectors and second connectors; and iii) a plurality of notches proximate the second side of the blade; the plurality of notches creating orifices in the second side, the third side and the fourth side of the blade, wherein each notch is adapted to securely engage a strand of woven wire;

c) a plurality of fasteners engaging openings and the apertures such that the first side of the blade engages the first side of the holder; and d) a handle attached to the second side, opposite the first side, of the holder; the handle connectable to a source of power adapted to cause the wire stretcher to stretch the woven wire.

2. The wire stretcher of claim 1, wherein each notch comprises a channel extending inward from the orifice of the second side of the detachable blade.

3. The wire stretcher of claim 2, wherein a gripping end of the channel extends away from the channel at an angle generally parallel the second the first side and the second side of the detachable blade.

4. The wire stretcher of claim 3, wherein the handle comprises and angled catch adapted to engage a device distinct from the handle.

5. The wire stretcher of claim 4, wherein:

a) the notches are equidistantly spaced apart from each other; or b) one or more of the notches are spaced apart at different distances relative to the distances between other notches.

6. A wire stretcher comprising:

a) a holder comprising a first side and a plurality of compatible first connectors and second connectors proximate the first side; each connector comprising an opening therethrough;

b) a detachable blade comprising:

i) a first side, a second side opposed from the first side, wherein the first side of the blade contacts the first side of the holder and the first side and the second side are connected to a third side and a fourth side of the blade;

ii) a plurality of apertures, extending through the blade, wherein each aperture is alignable with the compatible openings of the plurality of corresponding first connectors and second connectors; and iii) a plurality of notches proximate the second side of the blade; each notch is adapted to securely engage a strand of a wire;

c) a plurality of fasteners engaging openings and the apertures such that the first side of the blade engages the first side of the holder; and d) a handle attached to the second side, opposite the first side, of the holder; the handle connectable to a source of power adapted to cause the wire stretcher to stretch the wire.

7. The wire stretcher of claim 6, wherein each notch comprises a channel extending inward from the orifice of the second side of the detachable blade.

8. The wire stretcher of claim 7, wherein a gripping end of the channel extends away from the channel at an angle generally parallel the second the first side and the second side of the detachable blade.

9. The wire stretcher of claim 8, wherein the handle comprises and angled catch adapted to engage a device distinct from the handle.

10. The wire stretcher of claim 9, wherein:

a) the notches are equidistantly spaced apart from each other; or b) one or more of the notches are spaced apart at different distances relative to the distances between other notches.

* * * * *